US005576689A

United States Patent [19]

Queen

[11] Patent Number: 5,576,689

[45] Date of Patent: Nov. 19, 1996

[54] SELF TESTING PERSONAL RESPONSE SYSTEM WITH PROGRAMMABLE TIMER VALUES

[76] Inventor: Andrew Queen, 4744 S. Ocean Blvd., Highland Beach, Fla. 33487

[21] Appl. No.: 113,614

[22] Filed: Aug. 27, 1993

[51] Int. Cl.[6] ..... G08B 29/00; G08B 26/00; G08B 1/08; G08B 23/00

[52] U.S. Cl. ..... 340/514; 340/505; 340/539; 340/573; 379/38

[58] Field of Search ..... 340/573, 505, 340/539, 514, 825.69, 825.72, 825.54; 379/27, 29, 34.21, 38.70, 45.51, 39–44, 102, 106, 107; 455/67.1

[56] References Cited

U.S. PATENT DOCUMENTS

| | | | |
|---|---|---|---|
| Re. 34,496 | 1/1994 | Franklin et al. | 379/59 |
| 3,914,692 | 10/1975 | Seaborn, Jr. | 325/53 |
| 4,228,424 | 10/1980 | Le Nay et al. | 340/506 |
| 4,331,953 | 5/1982 | Blevins et al. | 340/539 |
| 4,578,671 | 3/1986 | Flowers | 340/636 |
| 4,612,534 | 9/1986 | Buehler et al. | 340/505 |
| 4,656,319 | 4/1987 | Bially | 379/29 |
| 4,686,697 | 8/1987 | Shapiro et al. | 379/38 |
| 4,772,876 | 9/1988 | Laud | 340/539 |
| 4,884,059 | 12/1989 | Shapiro | 340/514 |
| 4,908,602 | 3/1990 | Reich et al. | 340/514 |
| 4,918,432 | 4/1990 | Pauley et al. | 340/573 |
| 5,047,961 | 9/1991 | Simonsen | 364/550 |
| 5,128,579 | 6/1992 | Reich et al. | 379/40 |
| 5,146,207 | 9/1992 | Henry et al. | 340/573 |
| 5,228,449 | 6/1993 | Christ et al. | 379/38 |
| 5,255,306 | 10/1993 | Melton et al. | 379/38 |
| 5,333,173 | 6/1994 | Seazholtz et al. | 379/45 |

*Primary Examiner*—Victor R. Kostak
*Assistant Examiner*—John W. Miller
*Attorney, Agent, or Firm*—John C. Smith

[57] ABSTRACT

A personal response system which automates self testing of help consoles and personal transmitters. Testing is automatically performed at predetermined time intervals by the help console and problems are reported to the response center on a periodic basis. Both the personal transmitter and its battery are tested on a periodic basis and error signals are forwarded to the response center after a predetermined time period. The help console contacts the response center at predetermined time intervals and the failure to contact the response center generates an exception report at the response center.

17 Claims, 5 Drawing Sheets

SELF TESTING PERSONAL RESPONSE SYSTEM WITH PROGRAMMABLE TIMER VALUES

CROSS-REFERENCE TO RELATED APPLICATIONS

This application is related to the commonly owned copending applications entitled "Personal Response System With Emergency Audio Mode", filed Aug. 27, 1993, bearing U.S. Ser. No. 08/113,274, and "Programmable Personal Response System", filed Aug. 27, 1993, bearing U.S. Ser. No. 08/113,423, and naming Andrew Queen, the named inventor herein, as sole inventor, the contents of which is specifically incorporated by reference herein in its entirety.

BACKGROUND OF THE INVENTION

1. Technical Field

The present invention relates to personal response systems. In particular, it relates to personal response systems providing automated testing of help consoles and personal transmitters and automated communication of personal transmitter battery and personal transmitter system status to a response center.

2. Background Art

Personal response systems (PRS) have been used for a variety of applications. A basic PRS consists of a response center, help consoles, and personal transmitters. Typically, the response center is a hub facility with communication lines available to communicate with one or more help consoles. The help consoles are typically placed in dwellings where a user can activate the help console in an emergency. Personnel at the response center can take appropriate action when the help signal is activated by the help console. Optionally, a personal transmitter can be carried by the user to trigger the help console alarm in the event the user is unable to physically reach the help console.

A PRS can be put to use in a variety of situations. For example, a variety of industrial operations can employ a PRS to alert response center personnel of potential problems in various locations of a plant facility. A PRS can utilize sensor devices to automatically trigger fire alarms and notify the appropriate response center.

In addition to the foregoing, PRS's have found extensive use as support systems for older and/or disabled individuals. A serious concern among many such individuals is the possibility that they may be injured or otherwise need help and be unable to contact anyone. By having a help console at their home, an individual can contact a response center by pressing a personal transmitter button or equivalent on the help console. This provides dispatch of help which may be vital to the individual depending on the nature of the emergency. In addition, it also provides a measure of reassurance and peace of mind to these individuals because they know they can obtain help in an emergency by activating the help console.

In addition to the button located on the help console, a PRS may also have a personal transmitter which may be carried on the individual's person. This typically is a small battery operated transmitter which enables the individual to activate the help console remotely. This is of advantage when the individual is immobilized and cannot reach the help console.

The three basic components of the PRS are the response center, the help console, and the personal transmitter. When a response center receives an emergency signal from a help console, personnel at the response center open a two way channel with the party requesting help or take other action as required. The help console typically uses telephone lines for economic efficiency. However, a variety of technologies may be implemented to accomplish communication between the help console and the response station, such as cellular telephone transmission, radio, microwave links, etc. In addition, multiple redundant links may be used to protect against a failure in a given communication line. Likewise, the personal transmitter may use a variety of technologies to communicate with the help console, such as infrared, ultrasonic, radio, etc.

In addition to the communication of a help request, as discussed above, some systems have help console speakerphone arrangements. The integration of a speakerphone into the help console allows the personnel at the response center to speak directly to the individual at the help console. In turn, the exact nature of the problem can be determined quickly and in more detail.

The emergency signal may be activated from the help console or the personal transmitter. However, if the individual user is incapacitated in some way and cannot reach the help station, then the only way to activate the help console and alert the response center is with the personal transmitter. Since it may often be the only method of summoning help, the operational readiness of the personal transmitter is highly important. Further, since the personal transmitter is battery operated the status of the personal transmitter battery is a factor in overall effectiveness of the PRS. Previously, attempts have been made to test the condition of the help console, and the personal transmitter and its associated battery by having the response center periodically query some or all of the help consoles to ensure that the help console is operational. As part of the test of the personal transmitter, the individual would press the help button on the personal transmitter and the help console would indicate whether it received the signal from the personal transmitter. In the event of a fault, the individual would take appropriate steps to correct the problem, typically by first replacing the battery and then taking the personal transmitter in for service if the fault remained after the new battery was installed. The disadvantage to this approach is the impact on the response center in terms of the time and manpower it requires to perform this type of testing on large networks of help consoles. A further disadvantage is that the individual user must take some affirmative action to accomplish the test.

An individual acting alone could periodically test the unit and call the response center if the help console indicated a problem. However, testing by this method is also problematic in that the individual users still have to take some affirmative action. There is a significant possibility that many personal transmitters would never be tested in this manner because the individual would simply forget to perform the test. As a result, testing of the help consoles and personal transmitters with either of the foregoing methods is expensive and time consuming due to the need for active human intervention.

In addition to the demands on labor, by directing tests from the response center a significant burden is placed on response center system resources. In large networks of help consoles, the response center may only be able to test help consoles and personal transmitters infrequently. For example, a month or more may pass before a given unit is tested. As a result, many individuals may have inoperative personal transmitters or help units for extended periods which increases their risk of not being able to obtain help when required.

While existing PRS systems have provided significant benefit to individuals, they have not addressed the problem of excessive labor cost by hospital personnel and manual intervention by individual users when testing system components such as the help console or personal transmitter. Likewise, the prior art has failed to provide a timely testing procedure which allows equipment problems to be identified at the earliest date.

SUMMARY OF THE INVENTION

The present invention solves the foregoing problems by providing automated testing of the help console and personal transmitter. Testing is automatically performed by the help console and problems are reported to the response center on a periodic basis. Both the personal transmitter and its battery are tested on a periodic basis and error signals are forwarded to the response center after a predetermined time period. The help console contacts the response center at predetermined time intervals and the failure to contact the response center generates an exception report at the response center.

DESCRIPTION OF THE PREFERRED EMBODIMENT

Figure 1:
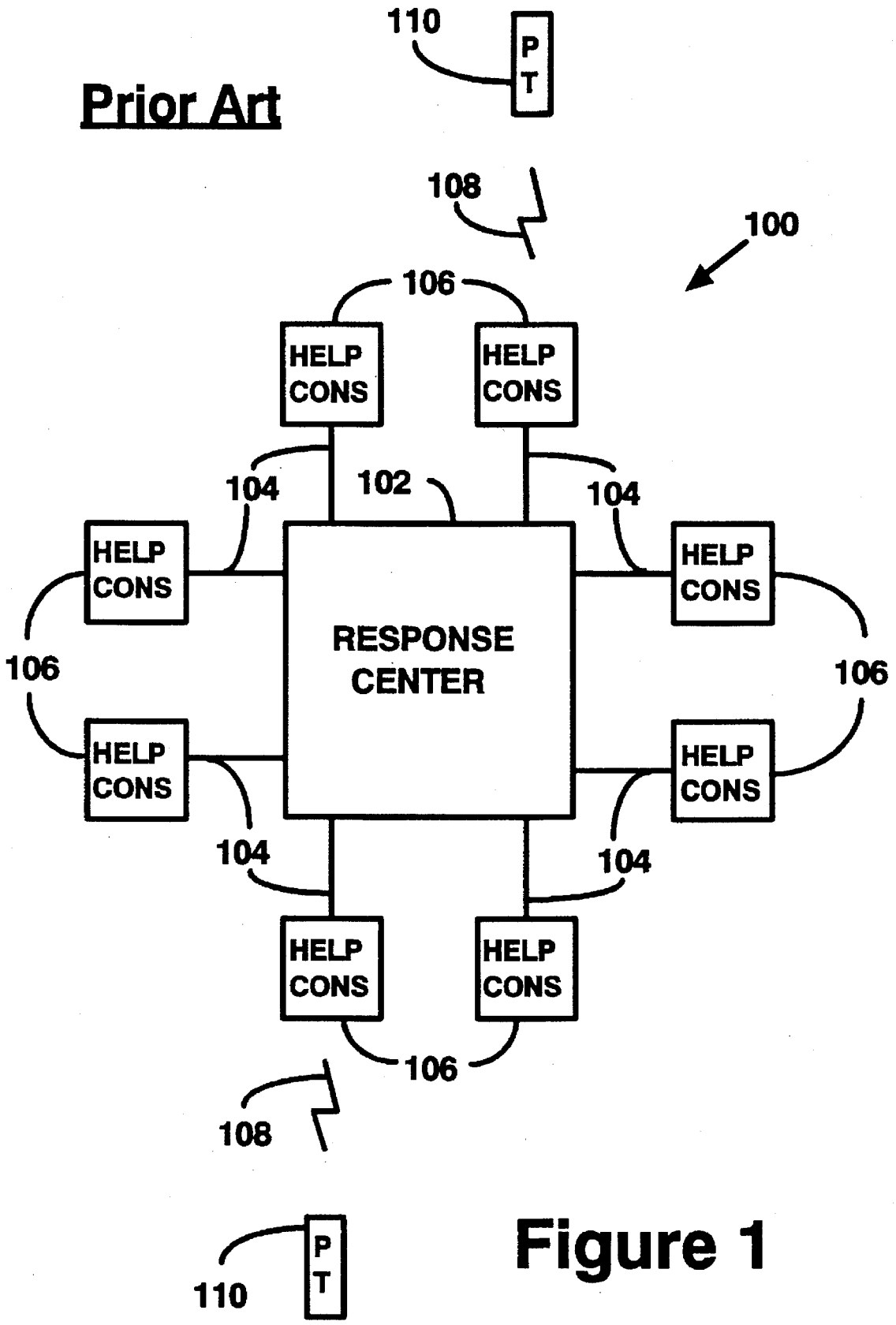
FIG. 1 is a diagram of a prior art PRS system.

FIG. 1 is illustrative of a typical prior art PRS system 100. A response center 102 has numerous communications lines 104 which allow help consoles 106 at remote locations to alert the response center to an emergency condition. Response centers are well known in the art and typically include numerous items of telephone and computer equipment. In addition to the help console, a personal transmitter 110 may be used to allow activation of the help console 106 from the remote location. Jagged line 108 represents a radio, infrared, or other suitable communication signal from personal transmitter 108 which triggers an emergency request by help console 106 over communication line 104. Numerous communication technologies, such a telephone, cellular, personal communication services, radio, microwave, etc., can perform this function. However, telephone communication is usually chosen as the most practical method. Dedicated lines are not required for the help console since automatic dialers can be used to contact the response center.

Figure 2:
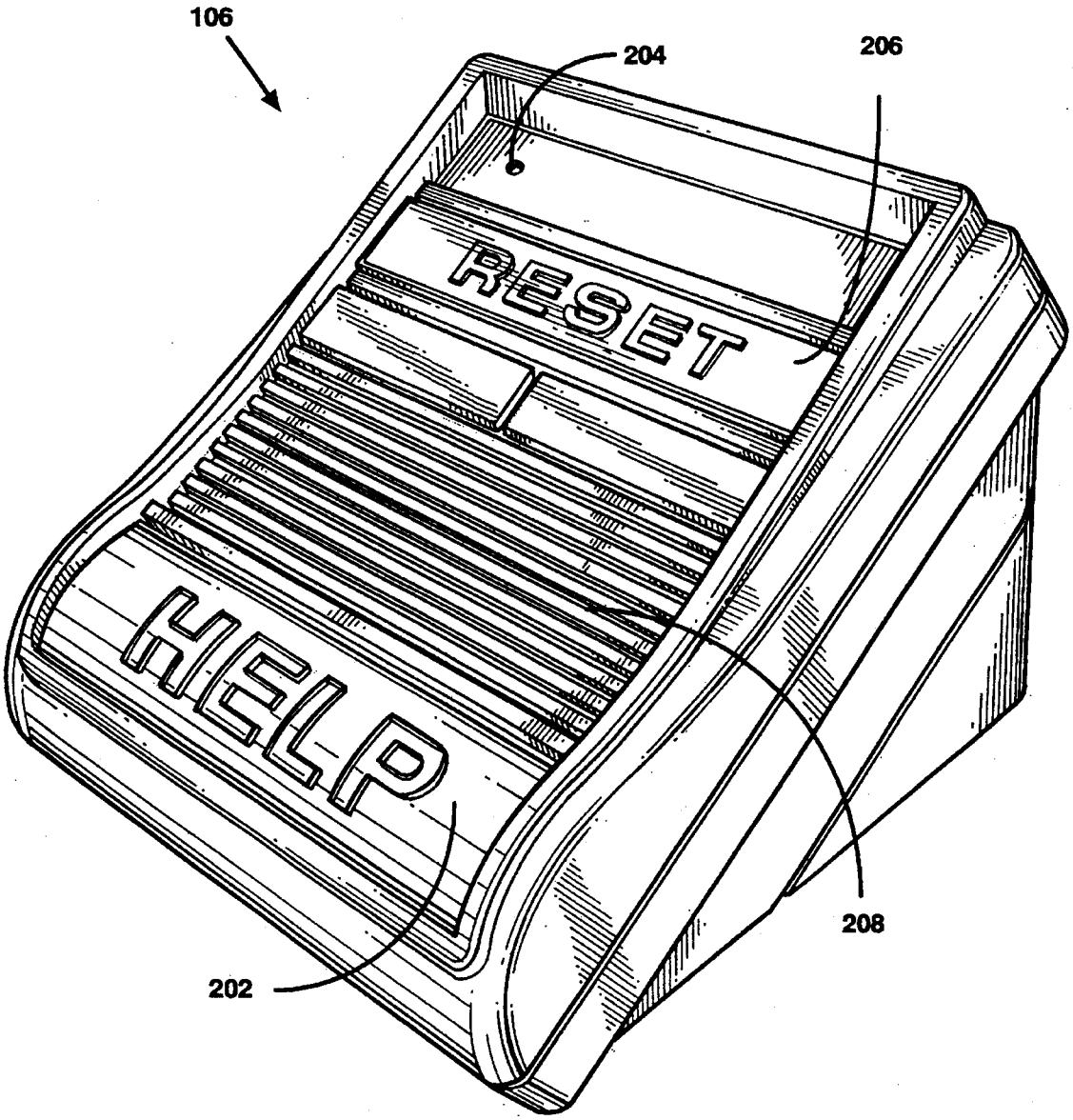
FIG. 2 is a diagram of a help console.

FIG. 2 shows the help console 106 used in the preferred embodiment. Help bar 202 activates a signal to the response center 102 indicating an emergency. Reset button 206 allows the emergency signal to be turned off by the individual user. Grill 208 conceals the console speaker (not shown) which is included in the speakerphone function of the help console. Microphone 204 is located on the front panel. Speakerphones are well known in the art.

Figure 3:
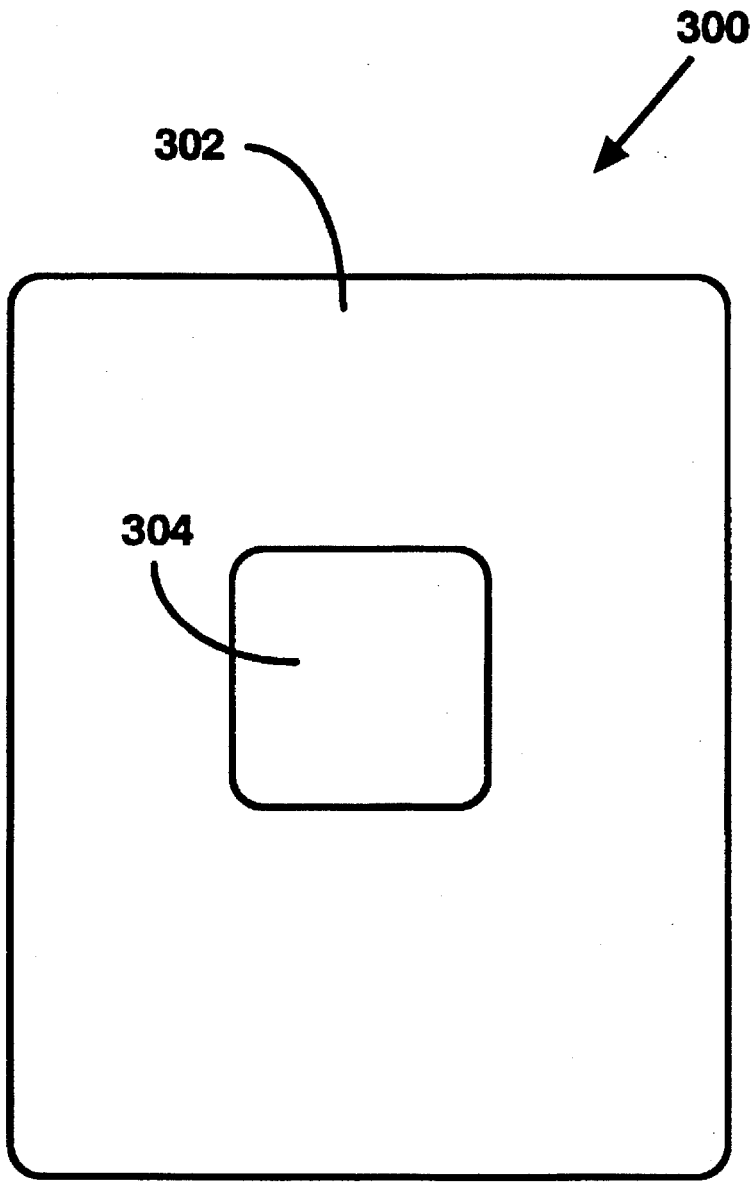
FIG. 3 is a diagram of a personal transmitter.

FIG. 3 shows the personal transmitter 300 used both in the prior art and in one embodiment of the instant invention. It includes an outer shell 302 and a help button 304. It contains a battery powered transmitter (not shown) which transmits a signal to the help console 106 when help button 304 is pressed. The signal from personal transmitter 300 activates help console 106 which then send an emergency signal to the response center 102. This type of transmitter is well known in the art.

Figure 4:
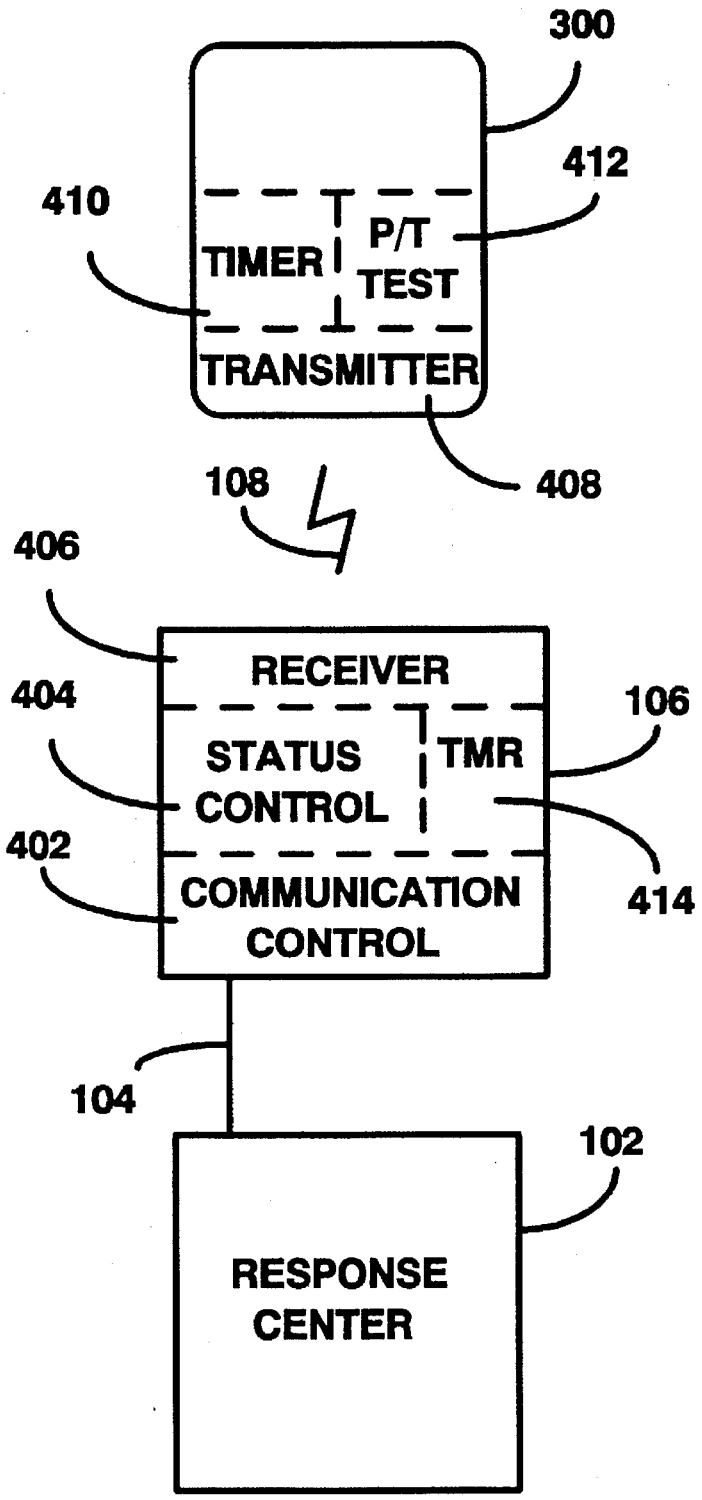
FIG. 4 is a diagram of a self testing PRS system.

FIG. 4 illustrates the self test mechanism embodied in the present invention. P/T test circuit 412 monitors the battery (not shown) in personal transmitter 300. At predetermined time intervals, timer 410 activates P/T test circuit 412 to test the battery. The test results from P/T test circuit 412 are input to transmitter 108 which transmits them to receiver 406 in help console 106. The timer is automatically activated without any intervention by the individual user. In the preferred embodiment, the timer is set for one hour test intervals.

Receiver 406 transfers the received battery status signal to status control 404. Status control 404 monitors the battery status signals sent by transmitter 408. When the battery is functioning properly, a battery status signal is transmitted when timer 410 times out. Status control 404 receives the battery signal within the selected time period and resets an internal timer 414 in help console 106. As long as the internal timer of help console 106 is continually reset, no error conditions are registered.

When the battery is low or inoperative, either an error signal or no signal is sent and the timer in status control 404 indicates a fault condition. Those skilled in the art will recognize that help console 106 could notify response center 102 immediately upon the occurrence of this event. However, immediate reporting will generate false error reports due to normal activity, such as the individual taking the personal transmitter 300 when leaving the dwelling for shopping trips, overnight trips, etc.

The preferred embodiment avoids this problem by maintaining a record of error conditions. When the count of consecutive errors reaches a predetermined level, status control 404 notifies response center 102 via communication control 402 and communication line 104. In the preferred embodiment, a period of seven to ten days is used. Those skilled in the art will recognize that the ideal time period will not be the same for all individual users. A relatively healthy individual is likely to be absent from the dwelling on short trips. Likewise, an invalid who could not travel would not normally have the personal transmitter 300 away from the house. As can be seen, the appropriate test period may vary from individual to individual. In the preferred embodiment, a period of seven to ten days is used to allow for short trips away from the dwelling while providing reasonably timely notice of errors.

In an alternative embodiment, the time period selected for error reporting to the response center 102 can be remotely programmed by the response center 102 via communications line 104. This allows different time periods to be used for different individuals depending on their particular needs.

While continuous testing is available as a result of this invention, the response center 102 does not receive any status concerning personal transmitter 300 from help console 106 unless there is an error in personal transmitter 300. However, this neglects the situation where help console 106 is inoperable and not communicating with response center 102. This is resolved by using the timer in help console 106 to initiate communication with the response center at predetermined intervals. If the response center does not receive the signal when due, an exception report can be automatically generated by the response center 102 to notify response center 102 personnel that there is a problem. In the preferred embodiment, the help console 106 initiates communication with the response center 102 daily. Implementation of the test monitoring and reporting functions can be easily implemented in hardware, but software is preferred because of the ease involved in customizing the PRS to suit the needs of individuals using the help consoles 106.

Status control 404 in help console 106 can also be programmed to execute tests on the help console 106. By providing self test capability, the internal timer of help console 106 can be used to control periodic testing without requiring active assistance from an individual user at help console 106 or from response center 102.

Figure 5:
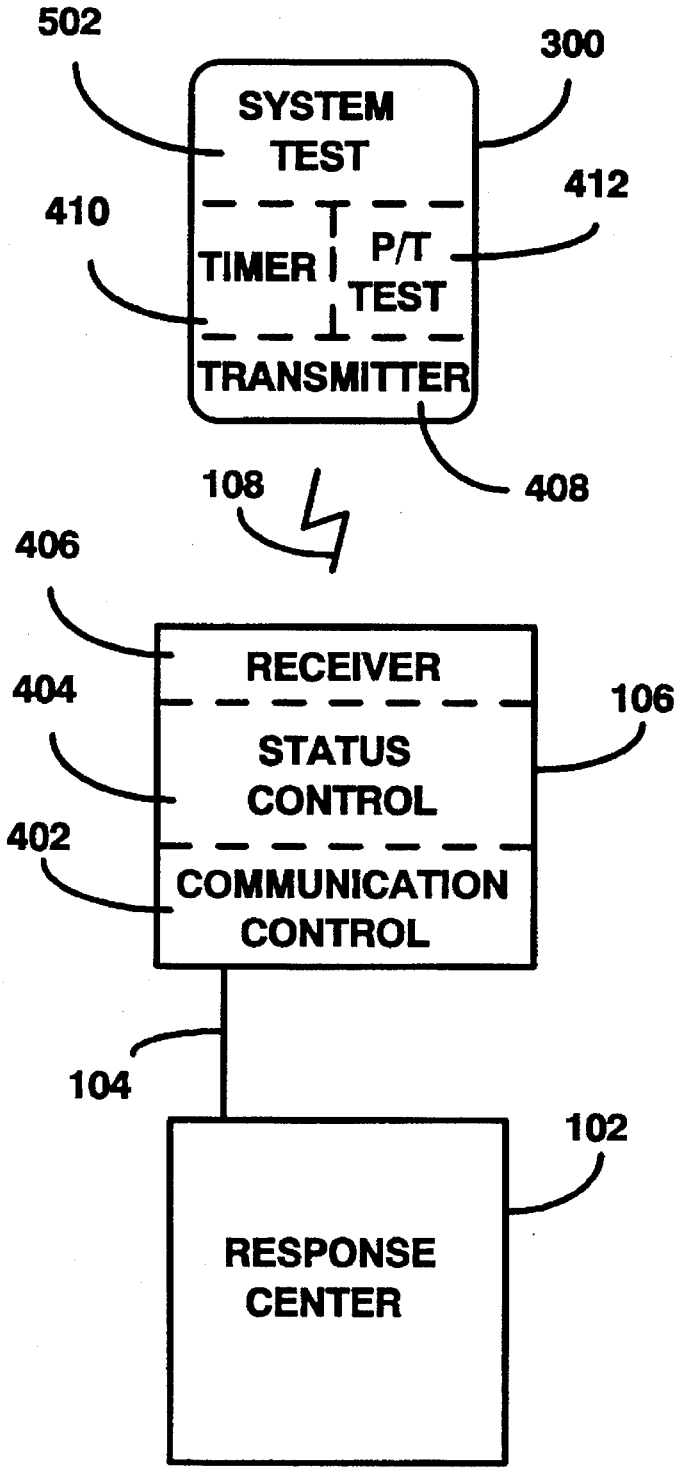
FIG. 5 is an alternative embodiment of a self testing PRS system.

FIG. 5 shows an alternative embodiment in which an additional system test 502 function is included in personal transmitter 300. System test 502 monitors the operation of the circuitry in personal transmitter 300 and provides a system status signal for transmission to help console 106. Those skilled in the art will recognize that both a battery status signal and a system status signal may be transmitted individually or a combined signal indicating correct battery and system circuit operation may be transmitted.

While the invention has been described with respect to a preferred embodiment thereof, it will be understood by those skilled in the art that various changes in detail my be made therein without departing from the spirit, scope, and teaching of the invention. For example, the time period used by the status control could be implemented by hardware switches. Likewise, software and hardware can be interchanged for a variety of functions within the PRS. An example of which would be the timer in the personal transmitter. Accordingly, the invention herein disclosed is to be limited only as specified in the following claims.

I claim:

1. A self testing personal response system, comprising:

a response center for monitoring a plurality of help consoles, the response center further comprising;

first communications means to communicate with the help consoles;

means to transmit timer values to the help console;

means to monitor testing of the help console; and at least one help console, further comprising:

second communication means to communicate with the response center;

first timer means;

means to receive timer values from the response center;

means to automatically execute self tests of the help console under control of the first timer means; and means to update the first timer means with the received timer values.

2. A system, as in claim 1, wherein the help console further comprises means to contact the response center at predetermined times as part of the self test.

3. A system, as in claim 2, wherein the response center further comprises means to indicate a help console failure if contact has not been made by the help console to the response center within a predetermined time period.

4. A system, as in claim 3, further comprising:

a personal transmitter, further comprising:

means to communicate with the help console;

a battery power source;

second timer means to initiate testing of the battery in the personal transmitter;

means to test the status of the battery and generate a first status signal indicating the status of the battery, and means to communicate the first status signal indicating the status of the battery to the help console;

the help console further comprising:

means to communicate with the personal transmitter;

the first timer means automatically tests for the absence of a predetermined number of first status signals;

reset means to reset the first timer means when a first status signal indicating valid battery operation is detected, and means to communicate the results of an invalid or missing first status signal to the response center under control of the first timer means.

5. A system, as in claim 2, further comprising:

a personal transmitter, further comprising:

means to communicate with the help console;

a battery power source;

second timer means to initiate testing of the battery in the personal transmitter;

means to test the status of the battery and generate a first status signal indicating the status of the battery; and means to communicate the first status signal indicating the status of the battery to the help console; and the help console further comprising:

means to communicate with the personal transmitter;

the first timer means automatically tests for the absence of a predetermined number of first status signals, reset means to reset the first timer means when a first status signal indicating valid battery operation is detected, and means to communicate the results of an invalid or missing first status signal to the response center under control of the first timer means.

6. A system, as in claim 1, further comprising:

a personal transmitter, further comprising:

means to communicate with the help console;

a battery power source;

second timer means to initiate testing of the battery in the personal transmitter;

means to test the status of the battery and generate a first status signal indicating the status of the battery; and means to communicate the first status signal indicating the status of the battery to the help console; and the help console further comprising:

means to communicate with the personal transmitter;

the first timer means automatically tests for the absence of a predetermined number of first status signals, reset means to reset the first timer means when a first status signal indicating valid battery operation is detected, and means to communicate the results of an invalid or missing first status signal to the response center under control of the first timer means.

7. A self testing personal response system, comprising:

a response center, further comprising means to transmit error timing values to the help console; and a help console, further comprising:

means to receive error timing values from the response center;

means to communicate with a personal transmitter;

means to automatically monitor self test status signals input from a personal transmitter at preselected times;

means to communicate with the response center to report error status if a predetermined number of consecutive status signals are not received from the personal transmitter within a predetermined period of time; and means to update the length of the predetermined period of time with the error timing values.

8. A system, as in claim 7, further comprising means in the help console to periodically self test the help console internal functions.

9. A system, as in claim 8, further comprising:

a personal transmitter, further comprising:
means to communicate with the help console,
a battery power source,
means to test the status of the battery,
first timer means to initiate testing, and
means to communicate a first status signal indicating the status of the battery to the help console after each test; and the help console further comprising:
second timer means to monitor the reception of the first status signal,
reset means to reset the second timer means when a first status signal indicating valid battery operation is received, and
means to communicate the results of an invalid or missing first status signal to the response center if a predetermined number of first status signals are not received.

10. A system, as in claim 9, further comprising:

means in the personal transmitter to transmit a status signal to the help console indicating the status of the personal transmitter at predetermined times;

means in the help console to communicate to the response center, at a second predetermined time, fault conditions indicated by the non-reception of a predetermined number of status signals.

11. A system, as in claim 7, further comprising:

a personal transmitter, further comprising:
means to communicate with the help console;
a battery power source;
means to test the status of the battery;
first timer means to initiate testing;
means to communicate a first status signal indicating the status of the battery to the help console;
means to reset the first timer means after each test; and the help console further comprising:
second timer means to monitor the reception of the first status signals;
reset means to reset the second timer means when a first status signal indicating valid battery operation is received; and
means to communicate the results of an invalid or missing first status signal to the response center if a predetermined number of status signals are not received.

12. A system, as in claim 11, further comprising:

means in the personal transmitter to transmit a first status signal to the help console indicating the status of the personal transmitter at predetermined times;

means in the help console to communicate to the response center, at a second predetermined time, fault conditions indicated by the non-reception of a predetermined number of first status signals.

13. A system, as in claim 7, further comprising:

a personal transmitter, further comprising:
means to communicate with the help console,
a battery power source,
means to test the status of the battery,
first timer means to initiate testing, and
means to communicate a first status signal indicating the status of the battery to the help console; and the help console further comprising:
second timer means to monitor the reception of the first status signal;
reset means to reset the second timer means when a first status signal indicating valid battery operation is received, and
means to communicate the results of an invalid or missing first status signal to the response center if a predetermined number of first status signals are not received.

14. A system, as in claim 13, further comprising:

means in the personal transmitter to transmit a first status signal to the help console indicating the status of the personal transmitter at predetermined times;

means in the help console to communicate to the response center, at a second predetermined time, fault conditions indicated by the non-reception of a predetermined number of first status signals.

15. A self testing personal response system, comprising:

a response center for monitoring a plurality of help consoles, the response center further comprising;
means to communicate with the help consoles;
means to transmit error timing values to the help console;
means to monitor for error status from the personal transmitters associated with the help consoles; and at least one help console, further comprising:
means to communicate personal transmitter error status to the response center if the personal transmitter does not communicate with the help console for a predetermined number of time intervals;
means to update the predetermined number of time intervals with the error timing values;

at least one personal transmitter, further comprising:
means to automatically execute self tests of the personal transmitter at predetermined time intervals;
means to communicate results of the self test to the help console.

16. A self testing personal response system, comprising:

a response center for monitoring a plurality of portable personal transmitters, the response center further comprising;
means to communicate with the portable personal transmitters;
means to transmit error timing values to the help console;
means to monitor reception of status information from the portable personal transmitters;
means to indicate an error condition if status information has not been received for a predetermined number of timer intervals;
means to update the predetermined number of time intervals with the error timing values; and at least one portable personal transmitter, further comprising:
first timer means;
means to communicate with the response center, and
means to automatically execute self tests under control of the first timer means and communicate the status information to the response center after each timer interval.

17. A system, as in claim 16, further comprising:

a portable personal transmitter, further comprising:
a battery power source;
means to initiate testing of the battery in the portable personal transmitter under control of the first timer means;

means to test the status of the battery and generate a battery status signal indicating the status of the battery, and means to communicate the battery status signal to the response center;

the response center further comprising:

second timer means to automatically test for the absence of a predetermined number of battery status signals, reset means to reset the second timer means when a battery status signal indicating valid battery operation is detected, and means to indicate an error when the battery status signal is missing for a predetermined amount of time.

* * * * *